US009273486B2

(12) United States Patent
Mansueto et al.

(10) Patent No.: US 9,273,486 B2
(45) Date of Patent: Mar. 1, 2016

(54) CONTINUOUS HANDLE FOR WINDOW

(71) Applicant: Milgard Manufacturing Incorporated, Taylor, MI (US)

(72) Inventors: Richard Mansueto, Gig Harbor, WA (US); Melvin Saunders, Auburn, WA (US); Michael Kuneman, Auburn, WA (US); Kevin D. Vilhauer, Puyallup, WA (US); Eric A. Baczuk, Puyallup, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 9 days.

(21) Appl. No.: 14/192,257

(22) Filed: Feb. 27, 2014

(65) Prior Publication Data

US 2014/0259946 A1 Sep. 18, 2014

Related U.S. Application Data

(60) Provisional application No. 61/793,718, filed on Mar. 15, 2013.

(51) Int. Cl.
*E05B 1/00* (2006.01)
*E05C 1/12* (2006.01)
*E05C 7/00* (2006.01)

(52) U.S. Cl.
CPC . *E05B 1/003* (2013.01); *E05C 1/12* (2013.01); *E05C 2007/007* (2013.01)

(58) Field of Classification Search
CPC ..... E05B 1/003; E05C 1/12; E05C 2007/007
USPC ..... 49/460, 449, 181, 184, 185, 186; 16/429; 292/163, 164, 167, 169, 173, 292/137, 140, 165, 177, 138, DIG. 20, 292/DIG. 26, DIG. 61, DIG. 65, DIG. 35, 292/DIG. 47, DIG. 31, 175, 145, 146, 150; 70/89, 90
See application file for complete search history.

(56) References Cited

U.S. PATENT DOCUMENTS

| | | | | |
|---|---|---|---|---|
| 2,632,537 | A * | 3/1953 | Marchand | 49/460 |
| 2,802,246 | A * | 8/1957 | Hodges | 49/447 |
| 2,978,757 | A | 4/1961 | Ammerman | |
| 3,131,960 | A * | 5/1964 | Popp | 293/1 |
| 3,139,923 | A * | 7/1964 | Guttman | 160/89 |
| 3,222,098 | A | 12/1965 | Hausfeld | |
| 3,706,467 | A * | 12/1972 | Martin | 292/111 |
| 4,828,299 | A | 5/1989 | Poe | |
| 5,326,141 | A | 7/1994 | Gorman | |
| 5,901,501 | A | 5/1999 | Fountaine | |
| 6,607,221 | B1 * | 8/2003 | Elliott | 292/33 |
| 6,764,115 | B1 | 7/2004 | Speed et al. | |
| 7,165,791 | B2 * | 1/2007 | Rebel et al. | 292/137 |
| 8,083,271 | B2 * | 12/2011 | Vilhauer | 292/137 |
| 8,182,001 | B2 * | 5/2012 | Tremble et al. | 292/32 |
| 2004/0221513 | A1 * | 11/2004 | Pettit | 49/449 |
| 2007/0289220 | A1 | 12/2007 | Vilhauer | |
| 2008/0129054 | A1 | 6/2008 | Tremble et al. | |
| 2013/0111819 | A1 * | 5/2013 | Tremble et al. | 49/449 |

* cited by examiner

*Primary Examiner* — Jerry Redman
(74) *Attorney, Agent, or Firm* — Rathe Lindenbaum LLP

(57) ABSTRACT

A window assembly includes a first sash having a first rail having a longitudinal axis extending between a first end and an opposite second end. A continuous handle extends along the length of the first rail and is pivotally connected to the first rail between a lowered first position and a second raised position.

15 Claims, 6 Drawing Sheets

CONTINUOUS HANDLE FOR WINDOW

CROSS-REFERENCE TO RELATED PATENT APPLICATIONS

This application is a Non-Provisional application claiming priority to the U.S. Provisional Application No. 61/793,718, filed Mar. 15, 2013, entitled "CONTINUOUS HANDLE FOR WINDOW", which is incorporated herein by reference in its entirety.

BACKGROUND

Single and double hung windows include a sash that moves vertically up and down as well as pivot along a bottom rail for cleaning and/or removal. A handle located on the upper rail of the sash activates a lock to lock the first sash relative to a second sash and/or frame. A pair of pivot latches may be located on the upper rail adjacent the respective vertical stiles of the sash to allow the sash to be pivoted out of the plane of the sash in normal operating position to allow for cleaning and/or removal of the sash.

SUMMARY OF THE INVENTION

In one embodiment, a window assembly includes a first sash having a first rail having a longitudinal axis extending between a first end and an opposite second end. A continuous handle extends along the length of the first rail and is pivotally connected to the first rail between a lowered first position and a second raised position.

In another embodiment a sliding window assembly includes a sliding sash having a first vertical stile, a second vertical stile spaced from and perpendicular to the first rail, and a pair of horizontal rails spaced from one another and perpendicular to the first and second rails. A handle is operatively attached to the first vertical stile and extending along the length of the first vertical stile, the handle substantially covering the surface of the first vertical stile in a first position and exposing the surface of the first vertical stile in a second position. A lock is operatively connected to the handle and configured to unlock the sash from a second sash or frame when the handle is moved from the first position to the second position.

In a further embodiment a method of operating a sliding window includes providing a first sash having a handle extending along an edge of the sash and moving the handle relative to the first sash from a first lowered position to a second raised position to unlock the first sash from a frame or second sash.

DETAILED DESCRIPTION OF THE EXAMPLE EMBODIMENTS

Figure 1:
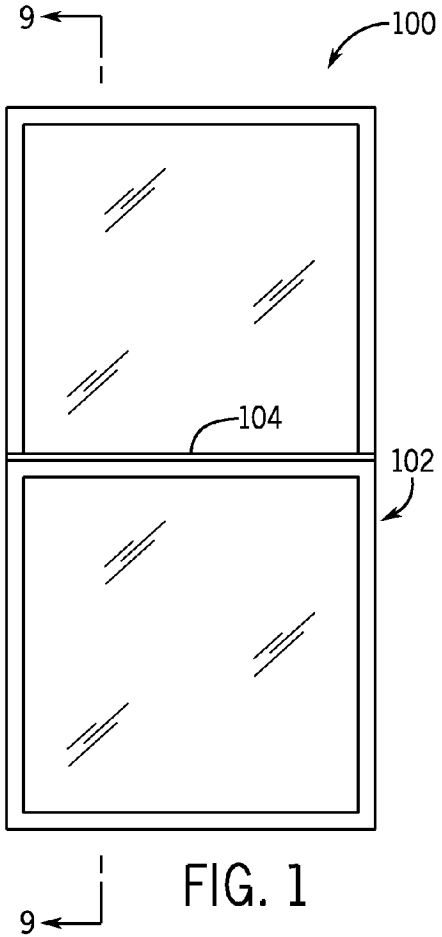
FIG. 1 shows a plan view of a window with a continuous handle.
Figure 11:
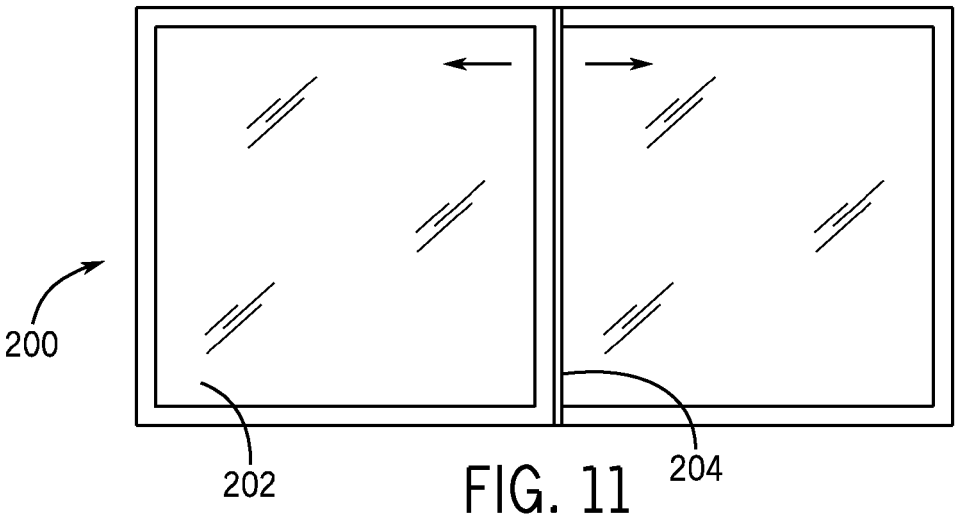
FIG. 11 is a sliding window having a continuous handle.
Figure 12:
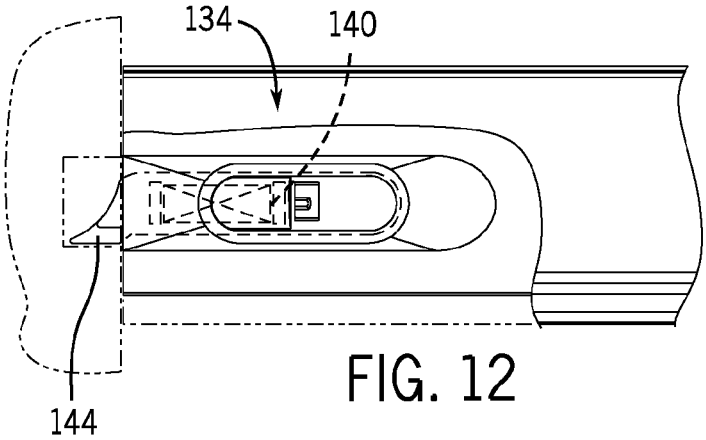
FIG. 12 is a pivot latch in the engaged position.
Figure 13:
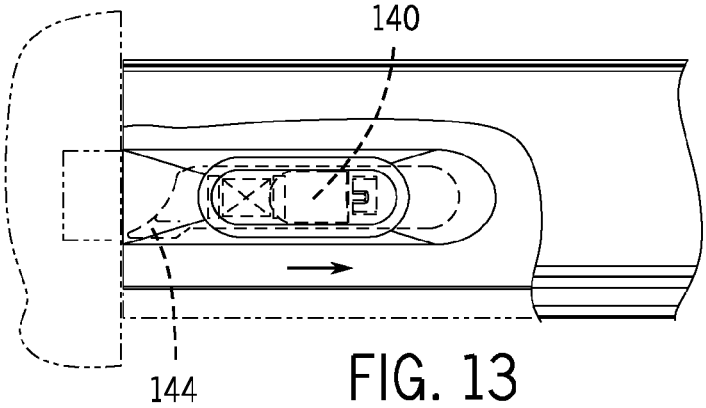
FIG. 13 is a pivot latch in the disengaged position.
Figure 14:
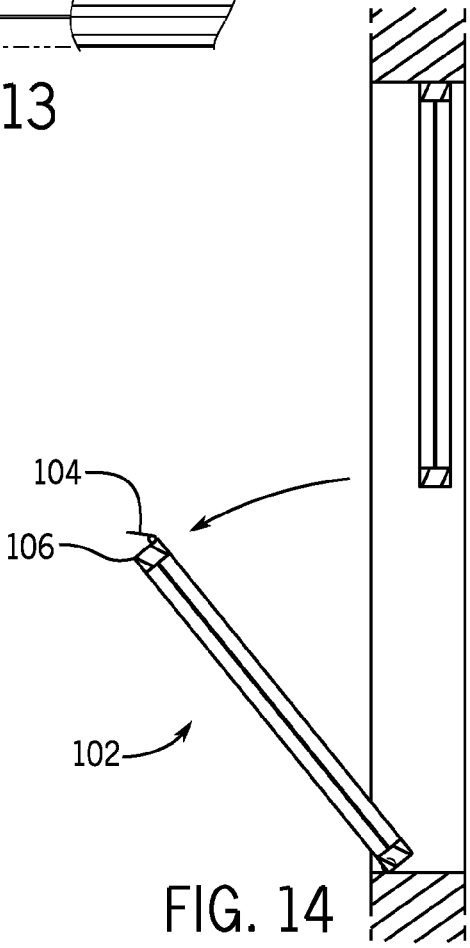
FIG. 14 is a cross sectional view of the window of FIG. 1 taken generally along lines 9-9 with the lower sash pivoted to an open position.

Referring to FIG. 1, a window 100 includes a first or lower sash 102 having a continuous handle 104. In one embodiment window 100 is a single or double hung window with a lower sash 102 that moves vertically between a closed position and an open position. Referring to FIG. 11, a continuous handle may also be used on a sliding window that slides horizontally. The window 100 will be described as a single or double hung window but the continuous handle may also be used in a sliding window.

The directions used herein reflect the orientation of a user facing the window from the interior of an enclosure. Inwardly includes the direction away from the window towards the user and the interior of an enclosure, up and down include the direction away from and toward the direction of gravity, while left and right include the direction as viewed by a user facing the window from the interior of an enclosure. The front will include facing the interior of the enclosure while the back will include the region facing away from the enclosure when the window is in the installed closed orientation.

Figure 2:
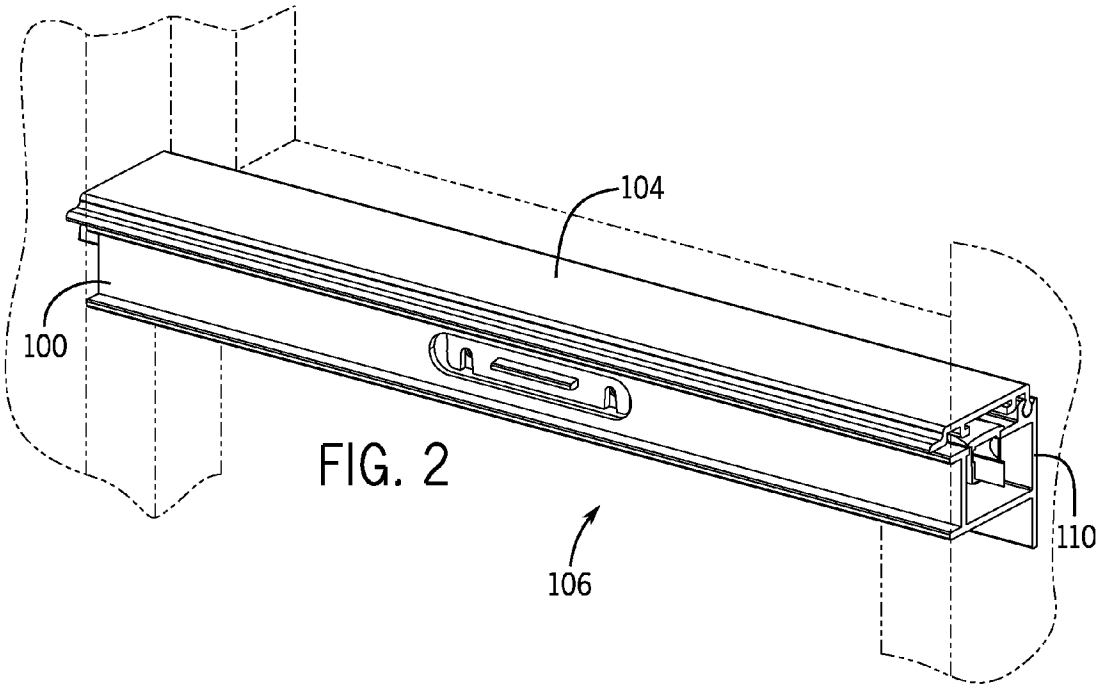
FIG. 2 shows the top rail of a lower sash of the window of FIG. 1 with the continuous handle in the closed position.

Referring to FIG. 2 lower sash 102 includes an upper rail 106 that pivotally supports continuous handle 104. Continuous handle 104 extends substantially the entire length of upper rail 106 from a first or leftward end 108 to the second or rightward end 110 of upper rail 106. In one embodiment, continuous handle 104 extends along the entire length of upper rail 106, while in another embodiment handle 104 extends less than the entire length of upper rail 106. It is contemplated that handle 104 may extend more than one half of the entire length, or less than one half of the entire length. In another embodiment, handle 104 extends from one end of rail 106 to the center region of rail 106 in a manner that the handle 104 is not symmetrical along rail 106.

Figure 4:
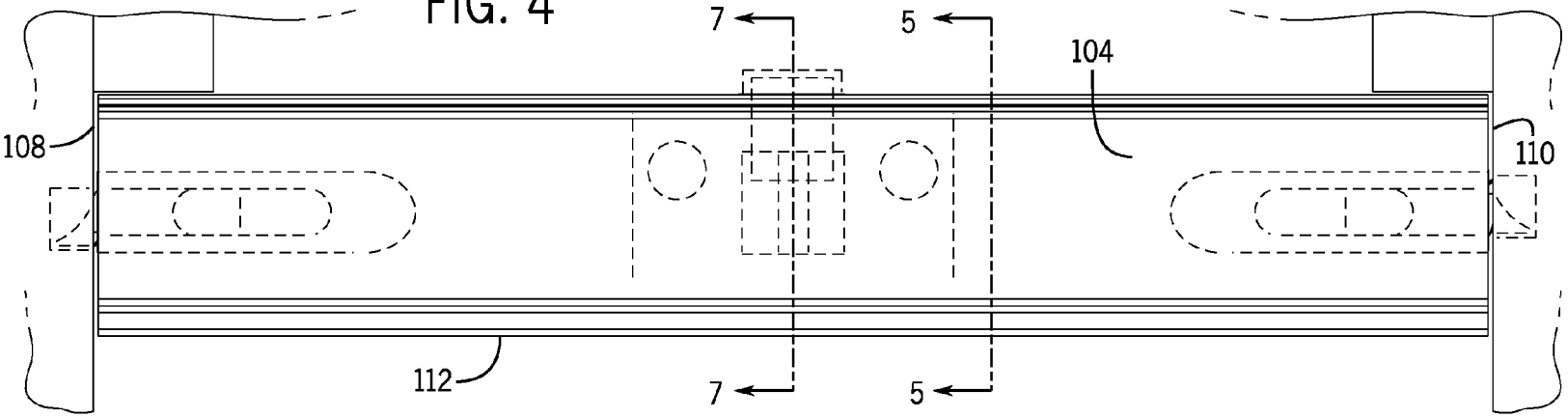
FIG. 4 shows a top view of the top rail of the lower assembly of the window.
Figure 6:
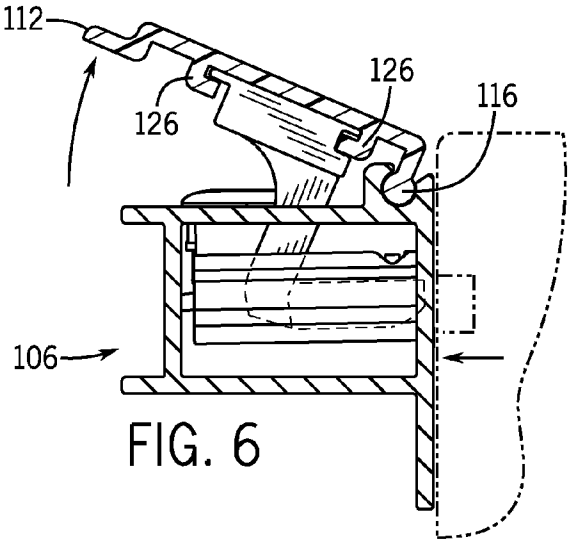
FIG. 6 is a cross-sectional view of the handle and upper rail of FIG. 4 taken generally along lines 5-5 when the handle is in the open position.
Figure 5:
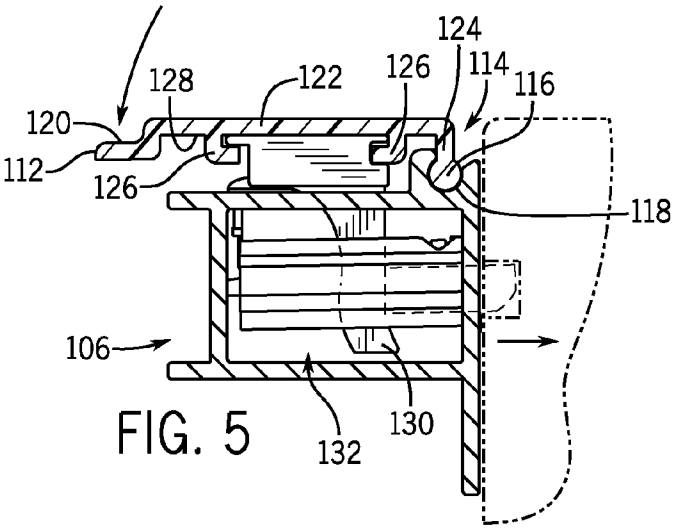
FIG. 5 is a cross-sectional view of the handle and upper rail of FIG. 4 taken generally along lines 5-5 when the handle is in the closed position.
Figure 7:
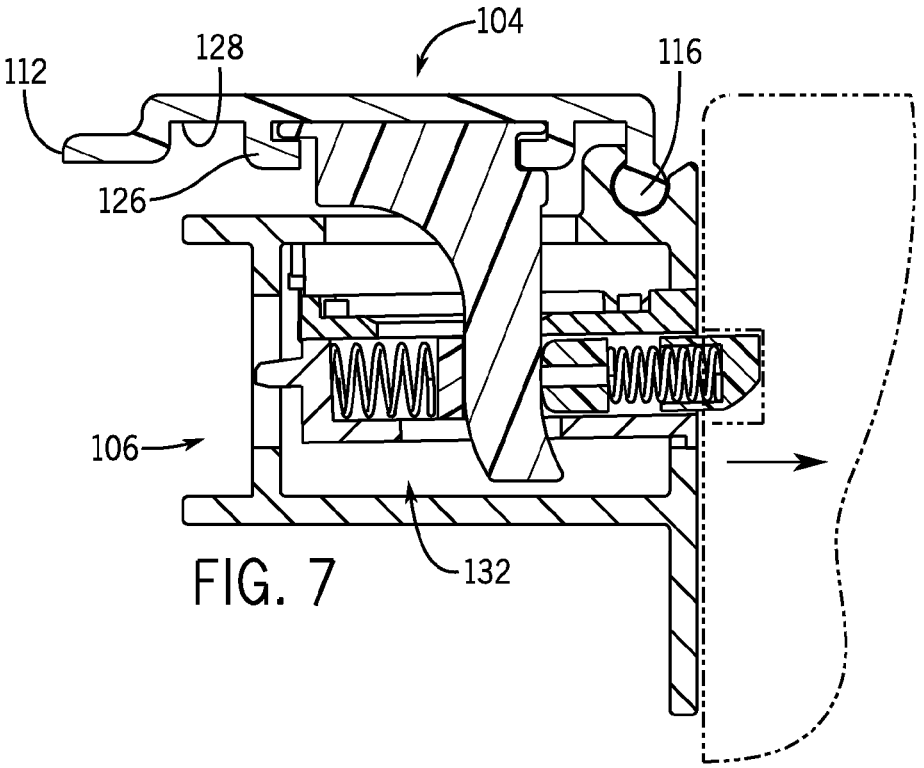
FIG. 7 is a cross-sectional view of the handle and upper rail of FIG. 4 taken generally along lines 7-7 when the handle is in the closed position
Figure 8:
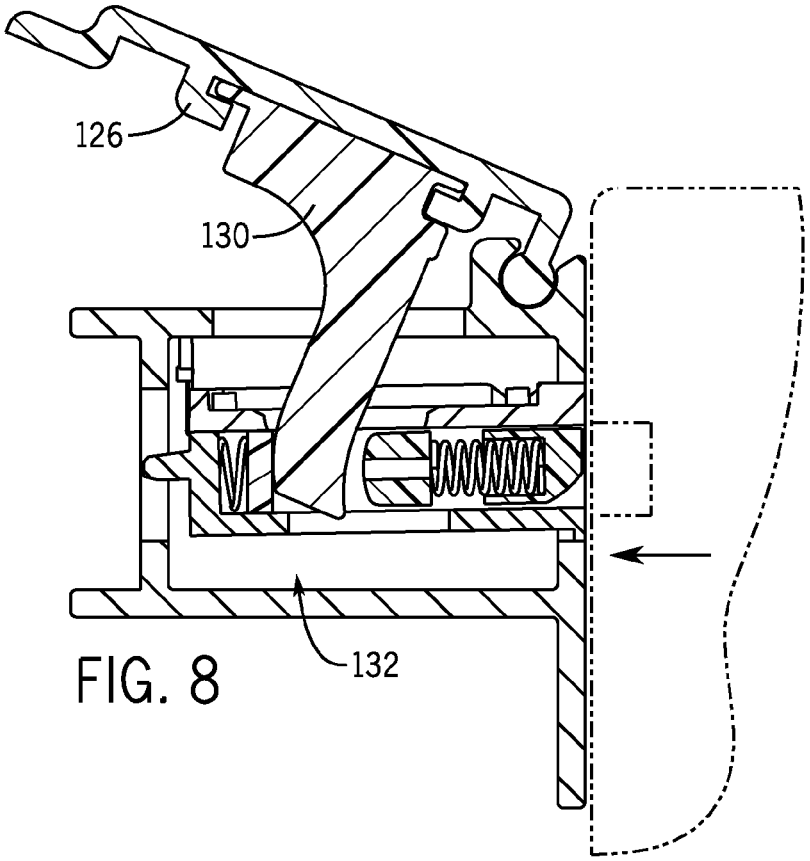
FIG. 8 is a cross-sectional view of the handle and upper rail of FIG. 4 taken generally along lines 7-7 when the handle is in the open position.
Figure 9:
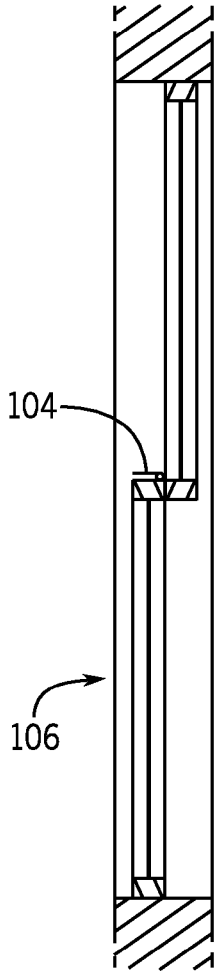
FIG. 9 is a cross sectional view of the window of FIG. 1 generally along the lines 9-9.
Figure 10:
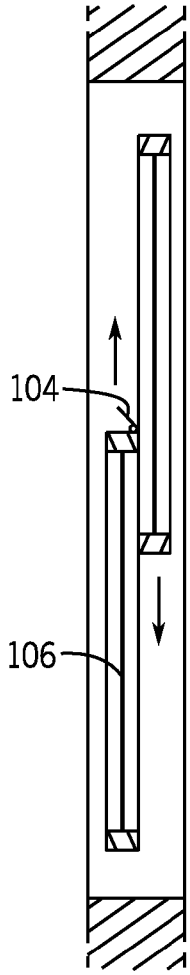
FIG. 10 is a cross sectional view of the window of FIG. 1 taken generally along lines 9-9 with the sashes moved from the closed position.

Referring to FIGS. 4-6 continuous handle 104 includes a front edge 112 and an opposing rear edge 114 having a pivot member 116 that operatively pivots within a groove 118 of upper rail 106. Referring to FIG. 5 the front edge 112 of continuous handle 104 includes a lip 120 positioned below an upper surface 122. Rear edge 114 includes a downwardly extending wall portion 124 terminating in an arcuate pivot member 116. Rear edge 114, wall portion 124 and pivot member 116 extend substantially the entire length of continuous handle 104 and upper rail 106.

Referring to FIG. 5 continuous handle 104 includes a pair of flanges 126 extending from a bottom surface 128 connecting a downward member 130 that operatively engages a lock 132. In a preferred embodiment lock 132 includes a lock of the type disclosed in U.S. Pat. No. 8,182,001 entitled Direct Action Window Lock incorporated herein by reference in its entirety. The lock disclosed in U.S. Pat. No. 8,182,001 ("the '001 patent") maintains the handle in an open or raised position when the sash is moved away from closed position. In this manner the top of the rail 106 is fully exposed allowing the user to have free access to each of the pivot latch 134, 136 without the need to hold open the continuous handle 104.

Pivot latches 134, 136 may be of the type having a slidable bolt 138 portion connected to a button or slide 140 located in and accessible through a depression in the top surface of rail. In another embodiment pivot latch 134, 136 may be of the type described in co-pending published patent application No. 2011/0192089 entitled Window Tilt Latch System ("the '089 publication") and incorporated herein by reference in its entirety. The latches disclosed in the '089 publication allow the latches to remain in an open withdrawn position while the window is tilted away from the frame and/or second sash and automatically moves to the closed or extended position when the sash is tilted back to the closed non-tilted orientation.

Referring to FIG. 1 and FIG. 5 handle 104 is in the lowered closed position covering both the top surface of upper rail 106 as well as covering the buttons or slide handle that activates the bolts of latches 134 and latch 136. Referring to FIG. 6, handle 104 is raised by a user by pushing member 120 upward and outward about pivot 116. As handle 104 is pivoted from the closed to open positions the lock bolt member is withdrawn from the second sash and/or frame thereby allowing the lower sash to be raised relative to the second sash and/or frame as shown in FIG. 11.

As discussed above when a direct action lock of the type described in the '001 patent is employed, handle 104 will remain in the raised position while the sash is moved from the closed position. This allows the user to have free access to each of the tilt latches 134, 136 without the need to simultaneously hold up the handle.

A user may then release the tilt latch bolts from the frame by either activating a button by pushing downward, or activating a slide by sliding horizontally toward the other tilt latch. Once the slide latch bolts have been withdrawn the sash may be tilted inwardly as illustrated in FIG. 15.

The handle 104 is typically the length of an entire side of a sash 102 of the window 100. In one embodiment sash 102 includes a pair of stiles 142 that are spaced apart and perpendicular to upper rail 106. Each stile having a first edge adjacent the glazing and a second edge distal the glazing. In one embodiment handle 104 has a length that is greater than the distance between the first edges of the first and second stiles. Stated another way handle 104 extends over at least a portion of both stiles when the handle 104 is in the first lowered position.

The application of hand pressure can be applied anywhere along the entire length of the handle 104 to activate lock 132 to unlock sash 102 from the second sash and/or frame. Pivoting handle 104 operates to unlock lock member 132. In the lowered position, the entire latch assembly and lock assembly are hidden from view providing a clean look as well as making cleaning of the upper exposed surfaces easier by providing a continuous uninterrupted surface.

The lip 120 of the continuous handle 104 further provides the lifting capability to open or unlocked the sash 102 about the pivot 116 in groove 118. Once the latch of lock 132 has been disengaged a user may continue to assert an upward pressure on lip 120 to raise sash 102 relative to the second sash and/or the frame. When lowering sash 102, a user may push down on handle 104 forcing the handle to the closed position while lowering the sash 102 to its original closed and lowered position. As described in the '001 patent, the handle 104 may be lowered without triggering the lock bolt back to its locked position. The lock bolt will automatically extend into the second sash and/or frame only once the lower sash is in the proper position relative to the second sash and/or frame.

Figure 3:
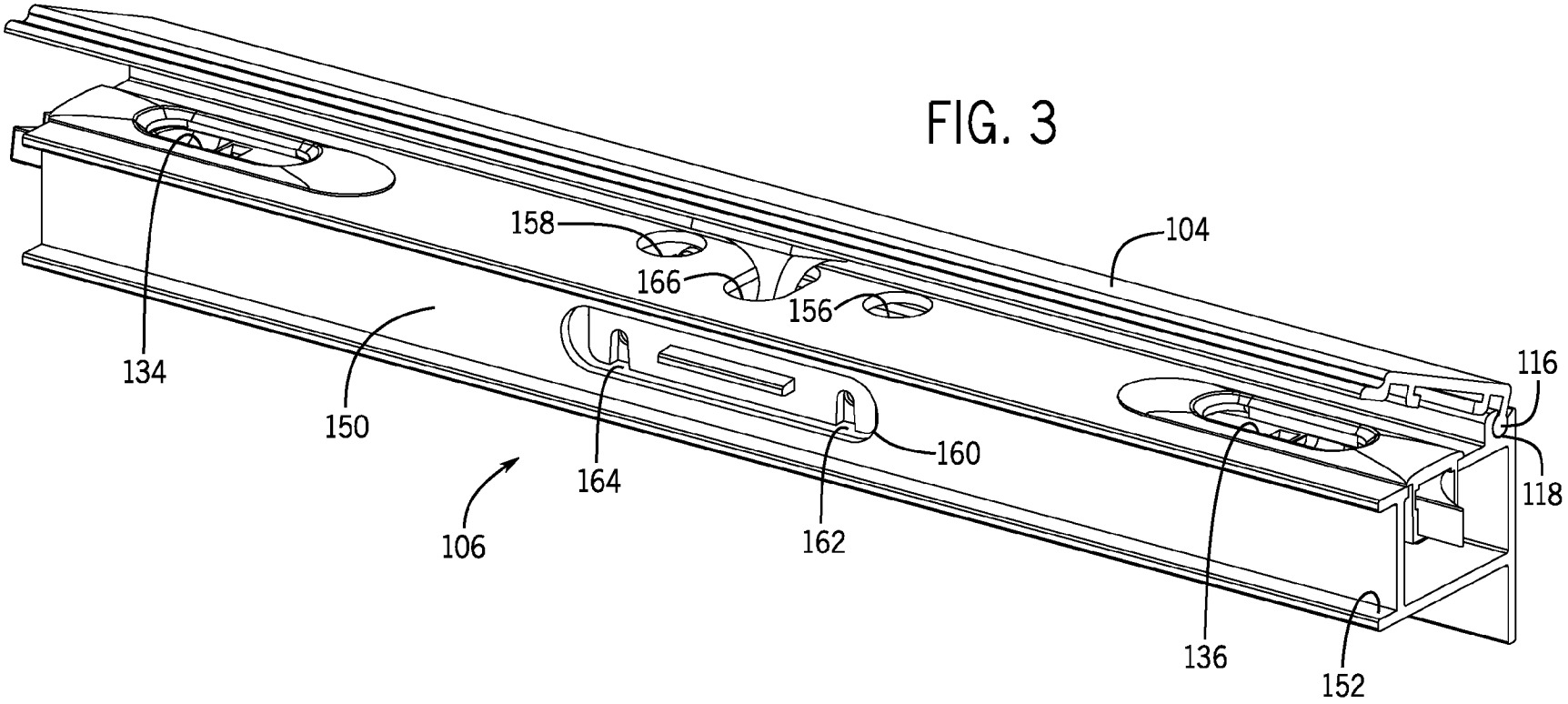
FIG. 3 shows the top rail of the lower sash with the continuous handle in the open position.

Referring to FIG. 3, in one embodiment upper rail 106 includes a front wall 150 that terminates in a lower inwardly extending ridge 152. Similarly, an inwardly upper inwardly extending ridge extends from the top surface of upper rail 106. Front wall 150 includes an opening 160 configured to receive lock 132 for installation purposes. A cover plate (not shown) may be secured to apertures 162, 164 in lock 132. In one embodiment apertures 162, 164 may include a female thread to receive a threaded fastener to secure a cover plate over aperture 160. In another embodiment, a decorative covering may extend the entire length of the upper rail 106 and extend between the top of rail 106 and the lower ridge 152. In one embodiment the decorative covering may be a wood or wood composite material selected to match the wood trim of the window opening and/or window. The decorative covering may also be operatively secured to the upper rail with a fastener that may be received within apertures 162, 164 of lock 132. Alternatively, the decorative covering may be secured to upper rail 106 directly with fasteners as are known in the art. Apertures 156, 158 may be used to secure an upper portion of lock 132 to upper rail 106. Aperture 166 provides an opening for handle member 130 to extend through the upper rail 106 to connect the continuous handle 104 with lock 132.

Referring to FIG. 11, a window 200 similar to window 100, only that the window sash 202 slides horizontally. The continuous rail 204 extends vertically instead of horizontally as with window 100. However, the continuous rail 204 operates in the same manner as continuous rail 104 with the components being orientated 90 degrees clockwise from the components of the single or double hung window 100. The same principles and operations that apply to the vertical sliding window 100, also apply to window 200 that slides horizontally. In one embodiment window 200 may include pivot latches similar to pivot latches 134, 136. However in another embodiment window 200 may include a single pivot latch located on the upper portion of movable sash 202. The single pivot latch may permit sash 202 to be removed from window 200. Finally it is also contemplated that window 200 may not include a pivot latch. The horizontal window 202 may be located above a kitchen sink or sufficiently high off of the ground that it may be difficult for some individuals to effectively reach a conventional lock located in the middle of the vertical rail. Continuous rail 204 allows for activation of a lock distal from the lower portion of sash 202 by pivoting a lower portion of rail 204. In this manner, activation of the lock between locked and unlocked positions is permitted without the need to reach to the middle of sash 202 as measured from the lower portion of sash 202 to the upper portion of sash 202. As discussed above with respect to handle 104, the lock disclosed in U.S. Pat. No. 8,182,001 ("the '001 patent") will maintain handle 204 in a raised position when the sash is moved away from the closed position. In the orientation of window 200 handle 204 will pivot such that the free end of handle 204 will extend to the right toward the second sash and remain in that rightwardly extended position while sash 202 is in the open position. Referring to FIG. 11, sash 202 will slide to the right in the open position. Handle 204 will pivot back to the original position away from the second sash when the sash is returned to the left/closed position and the lock is activated.

It is also contemplated that other locks known in the art may be used in combination with continuous handle 104 and/or handle 204.

It is important to note that the construction and arrangement of the latch mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A window assembly comprising:

a first sash having a first rail having a longitudinal axis extending between a first end and an opposite second end; and a continuous handle extending along the length of the first rail and being pivotally connected to the first rail and movable between a lowered first position a second raised position;

a lock being operatively connected to the handle, the lock being configured to lock and unlock the first sash from a second sash or frame;

a first tilt latch and a second tilt latch located within the first rail and each including a latch portion movable in and out of the respective first end and second end of the first rail;

wherein the first and second tilt latch movable portions may be manipulated by a first and second activator member respectively, each activator member being accessible by a user through a top surface of the first rail; and wherein the first and second activator members are covered by the continuous handle, when the continuous handle is in the lowered position, and exposed when the continuous handle is in the raised position.

2. A window assembly comprising:

a first sash having a first rail having a longitudinal axis extending between a first end and an opposite second end; and a continuous handle extending along the length of the first rail and being pivotally connected to the first rail and movable between a lowered first position a second raised position;

wherein the continuous handle includes an arcuate pivot member extending substantially the entire length of the first rail and pivotally engaged in a groove in the first rail, the groove being substantially adjacent a second longitudinal edge of the first rail parallel to and spaced from the first longitudinal edge of the first rail.

3. The window assembly of claim 2, further including a window lock operatively connected to the continuous handle.

4. The window assembly spring of claim 3, wherein the lock is configured to operatively retain the continuous handle in the raised position when the sash is moved from a closed orientation to an open orientation.

5. The window assembly of claim 4, wherein the lock is configured to be disengaged from a second sash or frame by manipulating the continuous handle at any point along its length.

6. The window assembly of claim 5, wherein the tilt latches are configured to retain the movable tilt latch members within a cavity of the continuous handle when the sash is moved to a tilted position.

7. The window assembly of claim 6, wherein the sash includes a pair of spaced stiles perpendicular to the first rail latch bolt now locks the door or window.

8. The window assembly of claim 7, wherein the continuous handle has a longitudinal distance greater than the distance between the longitudinal edges of each stile adjacent a glazing.

9. The window assembly of claim 2, wherein the first rail is horizontal.

10. The window assembly of claim 2, wherein the first rail is vertical.

11. A sliding window assembly comprising:

a sliding sash having a first vertical stile, a second vertical stile spaced from and perpendicular to the first rail, and a pair of horizontal rails spaced from one another and perpendicular to the first and second rails;

a handle operatively attached to the first vertical stile and extending along the length of the first vertical stile, the handle substantially covering the surface of the first vertical stile in a first position and exposing the surface of the first vertical stile in a second position;

a lock operatively connected to the handle and configured to unlock the sash from a second sash or frame when the handle is moved from the first position to the second position.

12. The window assembly of claim 11 further including a track configured to slidably receive a portion of one of rails.

13. The window assembly of claim 12 wherein the handle includes a pivot member extending along an entire edge of the handle that is received within a groove of the vertical member, the groove extending along the entire vertical length of the vertical member.

14. The window assembly of claim 13, wherein the lock is configured to retain the handle in the second position when the sash is moved from its closed position.

15. A method comprising:

providing a first sash having a handle extending along an edge of the sash;

moving the handle relative to the first sash from a first lowered position to a second raised position to unlock the first sash from a frame or second sash;

providing a first and second tilt latch each having a tilt latch activation member being located respectively on opposite sides of the sash, wherein the handle covers the tilt latch activation members when the handle is in the first lowered position.

* * * * *